United States Patent [19]

Kinkelaar et al.

[11] 4,405,663

[45] Sep. 20, 1983

[54] TIN PLATING BATH COMPOSITION AND PROCESS

[75] Inventors: Edmund W. Kinkelaar, Strongsville; Paul Golar, Shaker Heights, both of Ohio

[73] Assignee: Republic Steel Corporation, Cleveland, Ohio

[21] Appl. No.: 363,069

[22] Filed: Mar. 29, 1982

[51] Int. Cl.[3] ..... B05D 1/28

[52] U.S. Cl. ..... 427/428; 106/1.25; 427/436

[58] Field of Search ..... 204/54 R, 43 S, 27, 204/28; 106/1.22, 1.25; 427/437, 443.1, 428, 436

[56] References Cited

U.S. PATENT DOCUMENTS

| | | | |
|---|---|---|---|
| 2,457,152 | 12/1948 | Hoffman | 204/54 R |
| 2,813,804 | 11/1957 | Kendall et al. | 117/130 |
| 2,842,461 | 7/1958 | Wagner et al. | 117/130 |
| 3,323,938 | 6/1967 | Vaught | 117/71 |
| 3,607,317 | 9/1971 | Schneble | 106/1 |
| 3,709,714 | 1/1973 | Lee | 117/47 A |
| 3,857,684 | 12/1974 | Kubu | 29/196.5 |
| 3,917,486 | 11/1975 | Schneble | 106/1 |
| 3,930,072 | 12/1975 | Wilks | 427/306 |
| 4,027,055 | 5/1977 | Schneble | 427/98 |
| 4,093,466 | 6/1978 | Davis | 106/1.22 |
| 4,194,913 | 3/1980 | Davis | 106/1.22 |
| 4,278,477 | 7/1981 | Reinhold | 148/6.14 |

*Primary Examiner*—G. L. Kaplan

*Attorney, Agent, or Firm*—Watts, Hoffmann, Fisher & Heinke

[57] ABSTRACT

An immersion tin plating bath composition permits high speed plating of tin over zinc and zinc alloy coated steel. The bath consists of stannous ion, a mineral acid, a surfactant consisting of nonylphenoxypoly(ethyleneoxy)ethanol and Guar gum resin as a bodying agent. The combination of the surfactant and bodying agent makes it possible to obtain an adherent tin coating of minimum porosity and controlled, uniform thickness on a continuous basis by roll coating application.

10 Claims, No Drawings

TIN PLATING BATH COMPOSITION AND PROCESS

TECHNICAL FIELD

The present invention relates generally to chemical plating, and more specifically to an improved bath composition and process for immersion plating tin over zinc or zinc alloy coated steel.

The invention is particularly concerned with improvements in immersion or galvanic tin plating which make it possible to plate tin over zinc or zinc alloy coated steel strips on a continuous basis at high production line speeds, e.g. up to 500 feet per minute and higher. Immersion or galvanic plating generally involves an electromotive reaction in which the substrate metal displaces a less active metal ion from solution. In the case of immersion plating tin over zinc, the zinc coating on a steel web is partially dissolved to displace the stannous ion from an acid bath solution of a tin salt. The stannous ion plates out on the substrate as a thin coating.

For the most part, prior art immersion tin plating baths have not been adapted to high speed coating of a continuous web by roll coating techniques wherein a thin film of the plating bath is applied to the substrate surface. One reason for this is because many conventional baths are formulated such that the tin comes out of solution too slowly to permit continuous roll coater application. Attempts have been made to use acid plating baths with high tin ion concentrations in order to speed up the rate of plating. In general these attempts have resulted in deposits which are porous and poorly adherent. In addition it is difficult to control the thickness and uniformity of the deposit.

DISCLOSURE OF THE INVENTION

The invention provides an improved tin immersion bath which permits continuous plating of tin over zinc or zinc alloy coated steel by roll coating application. The bath and the associated process of roll coating is characterized by the presence of a surfactant consisting of nonylphenoxy-poly(ethyleneoxy)ethanol and a bodying or viscosity controlling agent consisting of Guar gum resin.

It has been discovered that the addition of a nonylphenoxy-poly(ethyleneoxy)ethanol having a molecular weight of from about 740 to about 1600, and more preferably from about 1100 to about 1540, makes it possible to control the rate at which the stannous ion is plated onto the substrate so as to result in the formation of an adherent film coating of uniform thickness and minimal porosity. It has also been discovered that the addition of Guar gum resin makes it possible to control the viscosity of the bath so that roll coating application of the bath to the plated steel web is possible. The use of Guar gum resin as the bodying agent is critical because it remains effective in the bath for any length of time. Other bodying agents have been found to become ineffective after periods of four hours or less.

In accordance with the foregoing, the present invention provides an aqueous immersion plating bath for plating tin over zinc coated steel, said bath comprising: stannous ion in an amount ranging from 50 to 100 grams per liter of water; sulfuric acid in an amount ranging from 20 to 100 grams per liter of water; nonylphenoxypoly(ethyleneoxy)ethanol in an amount ranging from 1.5 to 3.0 grams per liter of water; and Guar gum resin in an amount ranging from 1.5 to 11.5 grams per liter of water.

The invention also provides a method of immersion plating tin over zinc coated steel web on a continuous basis by roll coating application comprising the steps of: continuously running the coated steel web through a tin plating bath having the following composition:

1. about 50 to 100 grams of stannous ion per liter of water;
2. about 20 to 100 grams of sulfuric acid per liter of water;
3. 1.5 to 3.0 grams of a nonylphenoxy-poly(ethyleneoxy)ethanol per liter of water; and
4. 1.5 to 11.5 grams of Guar gum resin per liter of water; applying a wet film to said web in a thickness ranging from about 3.0 to 4.0 mils; contacting the strip with the bath for about 10 to 20 seconds; and operating said bath at a temperature ranging from 15.6° to 43.3° C.

As used herein the term "zinc" means zinc and zinc alloys.

In order to obtain maximum corrosion resistance, it is important in the practice of the invention to minimize porosity and achieve a smooth or non-granular tin deposit. When the concentration of sulfuric acid is less than about 20 grams per liter and greater than about 100 grams per liter, the deposit tends to be granular or crystalline. The preferred concentration is from 40 to 80 grams per liter of water. A concentration of stannous ion less than about 50 grams per liter results in a porous deposit, and concentrations greater than about 100 grams per liter result in deposits that are granular. The preferred stannous ion concentration is about 75 grams per liter of water.

It has been found that the molecular weight of the nonylphenoxy-poly(ethyleneoxy)ethanol surfactant affects the structure of the tin deposit and that the best deposits are achieved when the molecular weight is in a range of from about 740 to 1600, more preferably from about 880 to 1540 with the most preferred range being 1100 to 1540. Based on use of a surfactant having a molecular weight of 1100, the concentration of surfactant should be in the range of from 1.5 to 3 grams per liter with the preferred range being 2 to 3 grams per liter of water.

The concentration of the Guar gum resin and the temperature of the bath primarily affect the application of the coating rather then its structure. A low concentration of bodying agent will produce a low tin coating weight, and a high concentration of the gum resin will result in the bath turning into a gel so that coating is impossible. The bodying agent is present in an amount of from 3.5 to 9.5 grams per liter with the preferred amount being about 7.5 grams. At low temperatures the bath gels and at high temperatures the viscosity of the bath is too low for roll coating application. The preferred temperature range is from 15.6° C. to 43.3° C. (60° F. to 110° F.).

As discussed above, an important advantage of the invention is that the bath can be roll coated onto the steel plated web on a continuous production line basis. Line speeds may be 200 to 500 feet per minute or higher. An additional feature is that the web can be coated on one or both sides.

The plating of the tin from the film applied to the web is unexpectedly efficient with 90% or more of the stannous ion being depleted from solution. This high rate of plating efficiency avoids contamination of the bath by the zinc ion and makes it unnecessary to reclaim the bath material applied to the web. Other advantages include exceptional control of the thickness of the tin deposit and the ability to deposit a tin coating of extremely uniform thickness.

Still other advantages and a fuller understanding of the invention will be apparent from the following detailed description.

BEST MOSDE FOR CARRYING OUT THE INVENTION

The tin immersion plating bath and process of the present invention is characterized by the following composition and operating parameters:

| | Operating Range | Preferred Range | Optimum |
|---|---|---|---|
| Sulfuric Acid | 20–100 g/l | 40–80 g/l | 60 g/l |
| Stannous Ion | 50–100 g/l | | 75 g/l |
| Surfactant* Mol. Wt. | 740–1600 | 880–1540 | 1100–1540 |
| Surfactant Conc. | 1.5–3 g/l | | 1.5 g/l |
| Guar Gum Resin | 1.5–11 g/l | 3.5–9.5 g/l | 7.5 g/l |
| Operating Temp. | 15.5–43.3° C. | 23.9 C. | |
| Contact Time | 10–20 sec. | | |

*nonylphenoxy-poly(ethyleneoxy)ethanol (Igepal CO Series sold by GAF Corporation The effect of the operating parameters on the tin deposit was investigated by preparing a standard bath composition and then varying each parameter while keeping the others constant. The standard bath composition and operating conditions were as follows:

| | |
|---|---|
| Sulfuric Acid | 60 g/l |
| Stannous ion as Stannous Sulfate | 75 g/l |
| Igepal CO 850 Wetting Agent | 1.5 g/l |
| Guar Gum Bodying Agent | 7.5 g/l |
| Operating Temperature | 23.9 C. (75 F.) |
| Wet Film Thickness | 3.0 to 4.0 mil |
| Bath Contact Time | 15 sec |

The bath composition and operating parameters evaluated were:

| | |
|---|---|
| Sulfuric Acid | 20 to 100 g/l in 20 g/l increments |
| Stannous Ion Concentration | 25 to 125 g/l in 25 g/l increments |
| Igepal CO 850 Surfactant | 0.5 to 3.0 g/l in 0.5 g/l increments |
| Igepal CO Series Surfactant Molecular Wt. | 484 (CO 530) to 4620 (CO 997) |
| Guar Gum Bodying Agent | 1.5 to 11.5 g/l in 2.0 g/l increments |
| Temperature | 7.2 to 51.7° C. in 8.3 C. increments |

The surfactant molecular weight study covered the full range of Igepal CO Series of surfactants available from the GAF Corporation that are water soluble. The molecular weight increase from the lowest weight to the next molecular weight is not a uniform change; the weight increase becomes larger as the series progresses.

The deposition efficiency of the standard tin bath was also determined. In this evaluation, the wet film was applied to the zinc electroplated web for a 15 second contact time. The wet film was then rinsed from the panel and the rinsings were analyzed for tin content by titration. The tin deposit was stripped from the test panel and analyzed. Efficiency of the tin deposition was calculated as follows:

$$\frac{\text{Tin deposited (mg/total area in inches}^2)}{\text{Total tin in deposit and rinsings (mg/inches}^2)} \times 100$$

The tests used to evaluate the tin deposits were:

1. Tin Coating Weight
2. Deposit Porosity Test Results
3. Scanning Electron Microscope (SEM)
4. Heat Induced Tin Dewetting These tests were used to determine the effects of the varied operating parameters or bath composition on deposition efficiency and product properties. The tin coating weight indicates any change in deposition rate as the operating parameters were varied. The porosity shows the number of pores in the coating and indicates changes in coating porosity as the operating parameters are varied. Less porous tin coatings were considered more desirable. Coating structure was examined at 2000X magnification on the SEM to determine changes in the deposit as the operating parameters were varied. A smooth, well structured deposit was considered more desirable than a granular deposit. The effects of each operating variable on the coating properties are given in Tables I through VII. All of the variables studied except temperature had some effect on coating properties. However, good deposit properties are obtainable over a broad range of all variables.

The effect of sulfuric acid concentration on the tin deposit was examined. The results, shown in Table I, indicate that the tin coating structure at 2000X magnification is effected when the acid concentration is at the extremes of 20 and 100 g/l. At these acid concentrations, the coating structure changes from a smooth, matte appearance to a granular, crystalline structure. No other coating properties are effected by the concentration of sulfuric acid in the bath.

The effect of stannous ion concentration on the coating is shown in Table II. The results show that stannous ion concentrations in excess of 100 g/l cannot be maintained. At high concentrations the stannous ion will precipitate out of solution as tin oxy compounds and/or tin hydroxide. At the lowest stannous ion concentration studied, the quantity of tin in the 3 to 4 mil applied wet film is too low to produce a continuous deposit. These lighter deposits from the low stannous ion concentration bath also show more coating porosity. The high stannous ion concentration bath (100 g/l) gives a deposit that shows a granular, crystalline structure when viewed at 2000X magnification.

The effect of Igepal CO 850 surfactant concentration in the bath is shown in Table III. The deposits from baths containing 0.5 and 1.0 g/l Igepal CO 850 are granular, poorly structured and porous. Increasing the surfactant concentration to 1.5 g/l or more produces coatings that are smooth, well structured, less porous and less likely to show heat induced dewetting. It must be noted that this variable study was the only experiment where heat induced dewetting of the coating occurred. It is not readily apparent why dewetting occurred only in this series of experiments. Also, dewetting did not occur on porous, granular coatings produced when other bath components were varied in concentration. Factors other than coating structure must contribute to the heat induced dewetting phenomenon. It was also determined from the data that, at the 0.5 g/l Igepal CO 850 concentration, the tin deposit was lighter than that of the other sets in the series. It is likely that the very low Igepal concentration in the bath precluded adequate wetting of the zinc surface. Consequently, the tin deposit would be very light or non-existant in the unwetted areas.

The effect of the molecular weight of the Igepal CO series surfactants in the bath on the tin deposit is shown in Table IV. This series of non-ionic surfactants ranges in molecular weight from 484 to 4620, and represents the lowest water soluble molecular weight available from the GAF Corporation to the highest molecular weight available. The study shows that the lower (484 to 616) and higher (1980 to 4620) molecular weights produce porous coatings. Also, the lower weight surfactants produce granular, poorly structured deposits, in comparison to deposits from baths containing intermediate or high molecular weight wetting agents.

The effect of varying the concentration of the Guar gum bodying agent in the bath on the tin deposit is shown in Table V. The results show that the lowest bodying agent concentration gives a low tin coating weight. A low concentration of Guar gum does not body the bath enough to permit application of a 3 to 4 mil wet film thickness on the test panels. Conversely, the highest Guar gum concentration in the bath results in gelation of the bath and prevents application of a uniform wet film on the panel. No other effects can be attributed to the bodying agent concentration in the bath, as all of the tin coatings in this experiment showed good structure and properties.

The effect of bath temperatures on the tin deposit is shown in Table VI. The results show that 8.3° C temperature changes from 15.6° to 43.3° C. (60° to 110° F.) do not affect the tin deposit. At 7.2° C. (45° F.) the Guar gum bodying agent gels and the bath cannot be drawn-down applied. At temperatures above 43.3° C. (110° F.) the viscosity of the bath bodying agent drops rapidly and a 3 to 4 mil wet film of the bath cannot be applied to the test panels. No other affect of temperature was noted in this study.

While certain embodiments have been disclosed in detail, various modifications or alterations may be made herein without departing from the spirit or scope of the invention set forth in the appended claims.

TABLE I

AFFECT OF SULFURIC ACID CONCENTRATION

| $H_2SO_4$ Concentration in the Bath (g/l) | Tin Coating Weight in mg/π in.$^2$ | Tin Coating Thickness in μ-in. | Tin Coating Porosity Test Results | SEM Tin Coating Structure at 2000× |
|---|---|---|---|---|
| 20 | 10.9 | 30 | Moderate | Granular (Crystalline) |
| 40 | 12.9 | 35 | Moderate | Smooth |
| 60* | 12.5 | 34 | Moderate | Smooth |
| 80 | 12.5 | 33 | Moderate | Smooth |
| 100 | 11.6 | 32 | Moderate | Granular (Crystalline) |

*60 g/l = Standard Bath Concentration

TABLE II

AFFECT OF TIN CONCENTRATION

| Stannous Ion Concentration in the Bath (g/l) | Tin Coating Weight in mg/π in.$^2$ | Tin Coating Thickness in μ-in. | Tin Coating Porosity Test Results | SEM Tin Coating Structure at 2000× |
|---|---|---|---|---|
| 25 | 5.3 | 14 | Heavy | Smooth |
| 50 | 9.2 | 25 | Heavy | Smooth |
| 75* | 11.6 | 32 | Moderate | Smooth |
| 100 | 15.8 | 43 | Moderate | Granular |
| 125 | Tin precipitated from the bath due to high concentration. Bath not used due to heavy precipitation and depletion of stannous ions. | | | |

*75 g/l = Standard Bath Concentration

TABLE III

AFFECT OF IGEPAL CONCENTRATION

| Igepal CO 850 Concentration in the Bath (g/l) | Tin Coating Weight in mg/π in.$^2$ | Tin Coating Thickness in μ-in. | Tin Coating Porosity Test Results | SEM Tin Coating Structure at 2000× |
|---|---|---|---|---|
| 0.5 | 5.4 | 14 | Heavy | Granular |
| 1.0 | 7.7 | 21 | Heavy | Granular |
| 1.5* | 7.2 | 20 | Heavy | Smooth |
| 2.0 | 9.0 | 25 | Moderate | Smooth |
| 2.5 | 8.6 | 23 | Moderate | Smooth |
| 3.0 | 9.6 | 26 | Moderate | Smooth |

*1.5 g/l = Standard Bath Concentration

TABLE IV

AFFECT OF WETTING AGENT (IGEPAL CO SERIES) MOLECULAR WEIGHT

| Igepal Wetting Agent CO Number | Molecular Weight | Tin Coating Weight in mg/π in.$^2$ | Tin Coating Thickness in μ-in. | Tin Coating Porosity Test Results | SEM Tin Coating Structure at 2000× |
|---|---|---|---|---|---|
| 530 | 484 | 9.2 | 25 | Heavy | Granular |
| 610 | 572 | 10.2 | 28 | Heavy | Granular |
| 630 | 616 | 10.7 | 29 | Moderate | Granular |
| 720 | 748 | 8.5 | 23 | Moderate | Slightly Granular |
| 730 | 880 | 6.4 | 17 | Heavy | Smooth |
| 850 | 1100 | 7.2 | 19 | Moderate | Smooth |
| 887 | 1540 | 6.3 | 17 | Moderate | Smooth |
| 897 | 1980 | 5.3 | 14 | Heavy | Smooth |
| 977 | 2420 | 6.8 | 18 | Heavy | Smooth |
| 997 | 4620 | 6.7 | 18 | Heavy | Smooth |

*850 = Standard Bath Molecular Weight

TABLE V

AFFECT OF BODYING AGENT (GUAR) CONCENTRATION

| Guar Gum Concentration in the Bath (g/l) | Tin Coating Weight in mg/π in.$^2$ | Tin Coating Thickness in μ-in. | Tin Coating Porosity Test Results | SEM Tin Coating Structure at 2000× |
|---|---|---|---|---|
| 1.5 | 5.9 | 16 | Moderate | Smooth |
| 3.5 | 8.4 | 23 | Moderate | Smooth |
| 5.5 | 9.3 | 25 | Moderate | Smooth |
| 7.5* | 9.2 | 25 | Moderate | Smooth |
| 9.5 | 8.9 | 24 | Moderate | Smooth |
| 11.5 | 10.2 | 28 | Moderate | Smooth |

*7.5 g/l = Standard Bath Concentration

TABLE VI

AFFECT OF TEMPERATURE

| Temperature of Applied Wet Film °C. (°F.) | Tin Coating Weight in mg/π in.$^2$ | Tin Coating Thickness in μ-in. | Tin Coating Porosity Test Results | SEM Tin Coating Structure 2000× |
|---|---|---|---|---|
| 7.2 (45) | Bath solution congealed - drawdown application not possible. | | | |
| 15.6 (60) | 13.6 | 37 | Moderate | Smooth |
| 23.9 (75)* | 11.3 | 31 | Moderate | Smooth |
| 32.2 (90) | 10.9 | 30 | Moderate | Smooth |

we claim:

1. An aqueous immersion plating bath for plating tin over zinc coated steel, said bath comprising:

(a) stannous ion in an amount ranging from 50 to 100 grams per liter of water;

(b) sulfuric acid in an amount ranging from 20 to 100 grams per liter of water;

(c) nonylphenoxy-poly(ethyleneoxy)ethanol having a molecular weight of from about 740 to 1600 in an amount ranging from 1.5 to 3.0 grams per liter of water; and (d) Guar gum resin in an amount ranging from 1.5 to 11.5 grams per liter of water.

2. A plating bath as claimed in claim 1 wherein the concentration of sulfuric acid ranges from about 40 to 80 grams per liter of water.

3. A plating bath as claimed in claim 1 wherein the concentration of stannous ion is about 75 grams per liter of water.

4. A plating bath as claimed in claim 1 in which the concentration of nonylphenoxy-poly(ethyleneoxy)ethanol is from about 2 to 3 grams per liter.

5. A plating bath as claimed in claim 1 in which the concentration of Guar gum resin is from about 3.5 to 9.5 grams per liter.

6. An aqueous immersion plating bath for plating tin over zinc coated steel utilizing high speed roll coater applicators, said bath comprising:

(a) stannous ion in an amount ranging from 65 to 85 grams per liter of water;

(b) sulfuric acid in an amount of 40 to 80 grams per liter;

(c) nonylphenoxy-poly(ethyleneoxy)ethanol having an average molecular weight of from about 800 to about 1540 in an amount of about 1.5 grams per liter of water; and, (d) a Guar gum resin in an amount of about 7.5 grams per liter of water.

7. A method of immersion plating tin over zinc coated steel web on a continuous basis by roll coating application comprising the steps of:

(a) continuously running the coated steel web through a tin plating bath having the following composition:

1. about 50 to 100 grams of stannous ion per liter of water;
2. about 20 to 100 grams of sulfuric acid per liter of water;
3. 1.5 to 3.0 grams of nonylphenoxy-poly(ethyleneoxy)ethanol having a molecular weight of from about 740 to about 1600 per liter of water; and
4. Guar gum resin in amount of about 7.5 grams per liter of water;

(b) applying a wet film to said web in a thickness ranging from about 3.0 to 4.0 mils;

(c) contacting the strip with the bath for about 10 to 20 seconds; and, (d) operating said bath at a temperature of approximately 24° C.

9. A method of immersion plating as claimed in claim 8 in which said nonylphenoxy-poly(ethyleneoxy)ethanol has a molecular weight of from about 1100 to about 1540.

10. A method of immersion plating tin over zinc coated steel web on a continuous basis by roll coating application comprising the steps of:

(a) continuously running the coated steel web through a tin plating bath having the following composition:

1. about 50 to 100 grams of stannous ion per liter of water;
2. about 20 to 100 grams of sulfuric acid per liter of water;
3. 1.5 to 3.0 grams of nonylphenoxy-poly(ethyleneoxy)ethanol having a molecular weight of from about 740 to about 1600 per liter of water; and
4. 1.5 to 11.5 grams of Guar gum resin per liter of water;

(b) applying a wet film to said web in a thickness ranging from about 3.0 to 4.0 mils;

(c) contacting the strip with the bath for about 10 to 20 seconds;

(d) operating said bath at a temperature in the range of 15.5° C. to 43.3° C.; and (e) plating a tin coating onto said strip in a thickness ranging from 14 to 127 microinches.

* * * * *